United States Patent [19]

Jandér

[11] 4,430,938

[45] Feb. 14, 1984

[54] FUZE SAFETY DEVICE

[75] Inventor: Ulf Jandér, Karlskoga, Sweden

[73] Assignee: Aktiebolaget Bofors, Bofors, Sweden

[21] Appl. No.: 300,543

[22] Filed: Sep. 9, 1981

[30] Foreign Application Priority Data

Sep. 25, 1980 [SE] Sweden ..... 8006697

[51] Int. Cl.[3] ..... F42C 15/26

[52] U.S. Cl. ..... 102/232; 102/235; 102/248

[58] Field of Search ..... 102/232, 231, 233, 235, 102/236, 237, 238, 251, 254, 248, 276

[56] References Cited

U.S. PATENT DOCUMENTS

| | | | |
|---|---|---|---|
| 1,695,070 | 12/1928 | Varaud | 102/232 |
| 2,398,439 | 4/1946 | Middlemiss | 102/233 |
| 2,718,850 | 9/1955 | Kuhn | 102/238 |
| 3,547,035 | 12/1970 | Brackman et al. | 102/248 |
| 3,734,022 | 5/1973 | Bowers et al. | 102/248 |
| 3,779,169 | 12/1973 | Backstein et al. | 102/251 X |
| 4,154,169 | 5/1979 | Petiteau | 102/238 X |
| 4,320,705 | 3/1982 | Petiteau | 102/235 X |

FOREIGN PATENT DOCUMENTS

| | | |
|---|---|---|
| 1558047 | 12/1979 | United Kingdom . |
| 2023778 | 1/1980 | United Kingdom . |
| 1576842 | 10/1980 | United Kingdom . |

*Primary Examiner*—David H. Brown

*Attorney, Agent, or Firm*—Pollock, Vande Sande & Priddy

[57] ABSTRACT

The invention relates to a fuze safety device (1) for an ammunition unit such as a projectile, shell, rocket or the like. The safe and armed conditions of the fuze safety device are defined by a movable slide or rotor member which takes a first position in safe condition and a second position in armed condition and cooperates with at least two locking elements (7, 8). Each locking element has its own condition for release and in their released positions they permit the movable member to assume its second position. The locking members (7, 8) are arranged to cooperate mutually in such a way that both of the locking elements are released when their release conditions occur in a first order but release of at least one of the locking elements is inhibited if release conditions occur in a second order.

6 Claims, 3 Drawing Figures

FUZE SAFETY DEVICE

TECHNICAL FIELD OF THE INVENTION

The present invention relates to a fuze safety device for an ammunition unit such as a projectile, shell, rocket or the like. The safety device comprises a movable slide or rotor member for defining the safe and armed conditions of the device. The movable member occupies a first position in the safe condition and a second position in the armed condition and cooperates with at least two locking elements. Each locking element has its own condition for release, for instance a specific acceleration, a specific rotation, or the like. In their released positions, the locking elements permit the movable member to assume its second position.

BACKGROUND OF THE INVENTION

Fuze safety devices of the above-mentioned type are well known in the art. A fuze may for instance be armed by means of a slide member comprising a primer charge displaceable from a safe to an armed position under the influence of an external force caused, for instance, by the spinning of the ammunition unit.

Prior to firing of the ammunition unit the movement of the slide member is usually prevented by three locking elements: an axial locking member, a centrifugal locking member and an arming locking member, each of which is able to prevent the slide member from assuming its second, armed position. The axial and centrifugal locking members are released by acceleration and rotation, respectively, but the arming locking member can be released by a timer.

BRIEF SUMMARY OF THE INVENTION

Technical Problem

In prior fuze safety devices it has been important that the release of the different locking elements be carried out in a specific order and that the locking elements be fail safe in operation. If for instance the order is reversed or if a fault occurs in the timer, there is a substantial risk of accidental arming which in turn could inadvertently fire the munition inside or in the vicinity of the gun barrel.

Solution

The main object of the present invention is to provide a fuze safety device which solves the above-mentioned problems. The basic idea of the invention is then to arrange the locking elements in such a way that they inhibit each other if the relative order of their release is reversed. The invention is then mainly characterized in that the locking elements are arranged to cooperate mutually in such a way that both of the locking elements are released when said conditions occur in a first order but release of at least one of the locking elements is inhibited if said conditions occur in a second order.

To show how the invention can be carried out, specific embodiments of the invention are presented in the following description.

Advantageous Effects of the Invention

A fuze safety device of the above-mentioned kind is very safe against accidental arming. Another advantageous effect offered by the invention is that a more simple timer can be used. This means in turn that the fuze safety device can be provided with or be cooperating with an electronic timer without any reduction of the safe requirements of the fuze safety device as a whole.

BRIEF DESCRIPTION OF THE DRAWINGS

In the following a preferred embodiment of the fuze safety device according to the invention will be decribed with reference to the accompanying drawing, in which.

DESCRIPTION OF ILLUSTRATED EMBODIMENT

Figure 1:
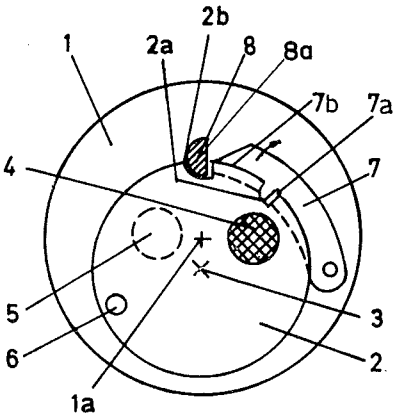
FIG. 1 is a horizontal view of the parts in question of a fuze safety device in a first functional position.

The invention can be applied on a fuze safety device which is known per se. FIG. 1 illustrates the invention applied on a fuze safety device which is partially known and which comprises a base 1. The base is provided with a movable slide or rotor member 2 arranged to be rotated about an axis 3. The movable member 2 comprises in a known way a primer charge 4 which should be moved from a safe, first position to an armed, second position in line with the "eye" of the fuze indicated by a circle 5 in dashed lines. These movements are carried out by rotation of the movable member 2 about the axis 3.

According to the invention the movable member 2 cooperates with several locking means or elements. One locking element comprises an axial locking member formed as a spring-loaded pin indicated by 6. When the projectile or the corresponding ammunition unit has reached a predetermined acceleration in connection with the firing of the projectile from for instance a gun barrel, the pin 6 is released and disengaged with the movable member 2 which then is free to be moved about its axis independent of said pin 6. A first locking means or element in the form of a centrifugal locking member 7 which is known per se comprises an arm pivoted at one end on the base 1 and spring-loaded against the member 2. The arm is provided with a locking device **7*a* which in the functional position illustrated in FIG. 1 engages the movable member 2 via a peripheral recess 2*a*. When the projectile or corresponding ammunition unit comprising the fuze safety device has reached a first condition, that is, a predetermined spinning movement, the arm 7 is lifted from the member 2 due to the centrifugal force so that the locking device 7*a* is disengaged from said recess 2*a* whereupon the member 2 is free to move independent of the centrifugal locking member. Arm 7 is also provided with a projecting lip 7*b* or corresponding means. A second locking means or elemet comprises an arming locking member which is controlled by a timer. Such control from a timer is known per se and not shown. The arming locking member is formed as a shaft 8 with a half-circular cross section and which is perpendicular to the plane of the paper of FIG. 1. When the shaft 8 is not actuated by the timer it takes a first rotary position or condition in which it is engaged with a recess 2*b* in the member 2. When the shaft 8 is actuated by the timer it is turnd to its second rotary position or condition in which the shaft is free from said recess 2*b* which in turn means that the member 2** is free to move independent of the arming locking member.

It should now be understood that the several locking means or elements operate independently of each other with respect to the movable member 2. As long as one of the locking means or elements has not been released, the member 2 is retained in the position illustrated in FIG. 1, the safe condition of the fuze safety device. The circular member 2 is suspended eccentrically in the base 1, which is also circular in a horizontal cross section. That is, the longitudinal axis 1*a* of the base 1 is parallel to the axis 3 of the member 2. The eccentric suspension of the movable member 2 in the base 1, which is rotating with the projectile or corresponding ammunition unit about the axis 1*a*, means that the member 2 is caused to rotate about its axis 3 as soon as all locking elements have been released. The movable member 2 and the base 1 are arranged in such a way that the rotational force on the movable member moves the member from its first to its second position in which the primer charge 4 is in line with the "eye" 5 of the fuze safety device.

Figure 2:
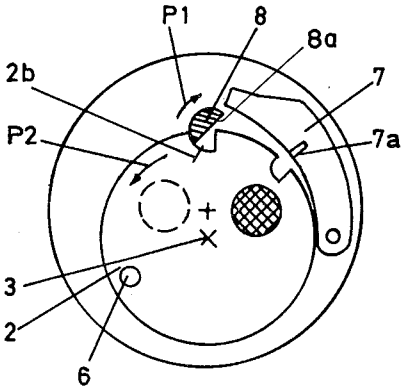
FIG. 2 is a horizontal view of the same parts as in FIG. 1 but in a second functional position.

FIG. 2 illustrates the normal arming process of the fuze safety device. The acceleration locking member 6 as well as the centrifugal locking member 7 are supposed to have been disengaged from the movable member 2. The timer (not shown) has released the arming locking member 8 which is turned in the direction indicated by the arrow P1. As soon as the arming locking member has reached its second position in which it is free from said recess 2*b*, member 2 commences its rotary movement about its axis 3 in the direction indicated by the arrow P2. Said arming process will only be started, however, if the centrifugal locking member has been released prior to the arming locking member.

Figure 3:
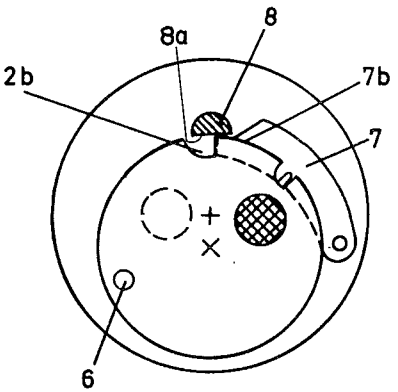
FIG. 3 is a horizontal view of the same parts as in FIG. 1 and 2 but in a third functional position.

In case that the arming locking member 8 is released before the centrifugal locking member 7, member 7 is locked in its safe position by a third locking means comprising the projecting lip 7*b* and the undersurface 8*a* of the arming locking member 8, as indicated in FIG. 3. The timer has actuated the arming locking member 8 into its second rotary position before a required centrifugal force has been obtained in the centrifugal locking member 7. The centrifugal locking member 7 maintains its safe or rest position when the arming locking member 8 is actuated and the arming and centrifugal locking members are constructed in such a way that the centrifugal locking member 7 is locked or retained in its initial position by the arming locking member 8. In case of a subsequent centrifugal force which normally should have lifted the centrifugal locking member 7, movement of member 7 is prevented and the centrifugal locking member is retained in its locked initial position. This means that the movable member 2 cannot be free with respect to all of the locking elements which in turn means that the fuze safety device remains in its safe condition.

In the specific embodiment in its third functional position according to FIG. 3 the arming locking member 8 engages the protruding lip 7*b* on the arm 7. This lip is provided with an upper surface which in the retained initial position of the centrifugal locking member 7 is in contact with the undersurface 8*a* of the arming locking shaft 8. The shaft 8 is then preferably made with a half-circular cross section.

The invention is not limited to the embodiment described here but can be modified within the scope of the accompanying claims.

INDUSTRIAL APPLICATION

The fuze safety device according to the present invention comprises comparatively simple parts which easily can be integrated in a rational manufacture of the fuze.

I claim:

1. A safety apparatus for an ammunition unit such as a projectile, shell, rocket or the like, said apparatus comprising:

a rotatable slide member for defining safe and armed conditions of the ammunition unit, said slide member being rotatable between a first position in which the ammunition unit is unarmed and a second position in which the ammunition unit is armed;

first locking means responsive to a first condition for releasing said slide member for rotation when said first condition reaches a predetermined value;

second locking means responsive to a second condition for releasing said slide member for rotation when said second condition reaches a predetermined value; and third locking means, operatively associated with said first and second locking means and operable in the event that said second condition occurs before said first condition so that said second locking means is the first to release said slide member, for preventing subsequent release of said slide member by said first locking means, whereby said slide member cannot be rotated to the armed position unless said first condition precedes said second condition.

2. A safety apparatus according to claim 1, wherein said first locking means is centrifugally actuated; further comprising a timer for actuating said second locking means.

3. A safety apparatus according to claim 2, further comprising a base supporting said slide member, wherein said first locking means comprises a locking member mounted on said base for movement relative to said slide member and said second locking means comprises a rotatable member having a surface which can engage and prevent movement of said locking member when said second condition occurs before said first condition.

4. A safety apparatus according to claim 2 further comprising a base supporting said slide member, wherein said first locking means comprises a locking member pivotably mounted to said base and said second locking means comprises a rotatable member having a surface which can engage and prevent movement of said locking member when said second contition occurs before said first condition.

5. A safety apparatus according to claim 4, wherein said locking member comprises a protruding lip for engagement by said surface of said rotatable member.

6. A safety apparatus according to claim 4, wherein said rotatable member comprises a shaft with a half-circular cross-section and said slide member comprises a recess for engaging said shaft in the locked position of said second locking means, said shaft member being rotatable to a release position which said half-circular cross-section is positioned outside of said recess and said slide member is released.

* * * * *